US006710746B1

(12) United States Patent
Anderson et al.

(10) Patent No.: US 6,710,746 B1
(45) Date of Patent: Mar. 23, 2004

(54) ANTENNA HAVING RECONFIGURABLE LENGTH

(75) Inventors: Theodore Anderson, Brookfield, MA (US); Igor Alexeff, Oak Ridge, TN (US)

(73) Assignee: Markland Technologies, Inc., Ridgefield, CT (US)

( * ) Notice: Subject to any disclaimer, the term of this patent is extended or adjusted under 35 U.S.C. 154(b) by 0 days.

(21) Appl. No.: 10/263,355

(22) Filed: Sep. 30, 2002

(51) Int. Cl.[7] ..... H01Q 1/26
(52) U.S. Cl. ..... 343/701; 343/709
(58) Field of Search ..... 343/701, 709, 343/710, 823, 745, 749; H01Q 1/26

(56) References Cited

U.S. PATENT DOCUMENTS

| | | | | |
|---|---|---|---|---|
| 2,557,961 A | | 6/1951 | Goldstein et al. | |
| 2,641,702 A | | 6/1953 | Cohen et al. | |
| 2,643,297 A | | 6/1953 | Goldstein et al. | |
| 3,155,924 A | | 11/1964 | Kaufman et al. | |
| 3,404,403 A | | 10/1968 | Vallese et al. | |
| 3,508,268 A | | 4/1970 | Forman | |
| 3,634,767 A | | 1/1972 | Roeder et al. | |
| 3,719,829 A | | 3/1973 | Vaill | |
| 3,779,864 A | | 12/1973 | Kaw et al. | |
| 3,914,766 A | | 10/1975 | Moore | |
| 4,001,834 A | | 1/1977 | Smith | |
| 4,028,707 A | | 6/1977 | Young et al. | |
| 4,049,940 A | * | 9/1977 | Moisan et al. | 219/10.55 R |
| 4,062,010 A | | 12/1977 | Young et al. | |
| 4,090,198 A | | 5/1978 | Canty et al. | |
| 4,347,512 A | | 8/1982 | Sweeney | |
| 4,473,736 A | | 9/1984 | Bloyet et al. | |
| 4,574,288 A | | 3/1986 | Sillard et al. | |
| 4,611,108 A | | 9/1986 | Leprince et al. | |
| 4,989,013 A | | 1/1991 | Smith, II et al. | |
| 5,175,560 A | | 12/1992 | Lucas et al. | |
| 5,546,096 A | | 8/1996 | Wada | |
| 5,594,456 A | | 1/1997 | Norris et al. | |
| 5,963,169 A | | 10/1999 | Anderson et al. | |
| 5,990,837 A | | 11/1999 | Norris et al. | |
| 6,046,705 A | | 4/2000 | Anderson | |
| 6,087,992 A | | 7/2000 | Anderson | |
| 6,087,993 A | | 7/2000 | Anderson et al. | |
| 6,118,407 A | | 9/2000 | Anderson | |
| 6,169,520 B1 | | 1/2001 | Anderson | |
| 6,369,763 B1 | | 4/2002 | Norris et al. | |

FOREIGN PATENT DOCUMENTS

| | | |
|---|---|---|
| WO | WO 00/21156 | 4/2000 |

OTHER PUBLICATIONS

"A Theoretical and Experimental Study of a Microwave Plasma Closing Switch", Weng Lock Kang, Mark Rader and Igor Alexeff, UTK Plasma Science Laboratory, Department of Electrical and Computer Engineering, University of Tennessee, Knoxville, TN, p. 41P03.

* cited by examiner

*Primary Examiner*—Hoanganh Le
(74) *Attorney, Agent, or Firm*—Thorpe North & Western, LLP

(57) ABSTRACT

The present invention is drawn to an antenna having a reconfigurable length, and a method of reconfiguring an antenna. The antenna can comprise an enclosed composition capable of forming plasma operable as an antenna; an energy source configured for applying variable energy levels to the composition to thereby form variable plasma configurations; and an enclosure containing the composition. The enclosure can have a proximal end, wherein upon application of a first energy level to the composition, a first plasma length with respect to the proximal end is formed, and upon application of a second energy level to the composition, a second plasma length with respect to the proximal end is formed.

30 Claims, 5 Drawing Sheets

ANTENNA HAVING RECONFIGURABLE LENGTH

FIELD OF THE INVENTION

The present invention relates generally to plasma antenna systems. More particularly, the present invention relates to plasma antennas having reconfigurable length, and optionally, reconfigurable beamwidth and bandwidth.

BACKGROUND OF THE INVENTION

Traditionally, antennas have been defined as metallic devices for radiating or receiving radio waves, or as a conducting wire which is sized to emit radiation at one or more selected frequencies. As a result, the paradigm for antenna design has been focused on antenna geometry, physical dimensions, material selection, electrical coupling configurations, multi-array design, and/or electromagnetic waveform characteristics such as transmission wavelength, transmission efficiency, transmission waveform reflection, etc. Technology has advanced to provide many unique antenna designs for applications ranging from general broadcast of RF signals to weapon systems of a highly complex nature.

To maximize effective radiation of such energy, an antenna can be adjusted in length to correspond to a resonating multiplier of the wavelength of frequency to be transmitted. Accordingly, typical antenna configurations will be represented by quarter, half, and full wavelengths of the desired frequency. Efficient transfer of RF energy is achieved when the maximum amount of signal strength sent to the antenna is expended into the propagated wave, and not wasted in antenna reflection. This efficient transfer occurs when the antenna is an appreciable fraction of transmitted frequency wavelength. The antenna will then resonate with RF radiation at some multiple of the length of the antenna. Due to this, metal antennas are somewhat limited in breadth as to the frequency bands that they may radiate or receive.

Recently, there has been interest in the use of plasmas as the conductor for antenna elements, as opposed to the use of metals. This interest is due in part to the fact that plasma antennas can be designed to be more flexible in use than traditional metal antennas. Due to the dynamic reconfigurability of plasma antennas, some limitations previously known to exist with metal antennas are beginning to be removed.

SUMMARY OF THE INVENTION

It has been recognized that it would be advantageous to develop an antenna element having reconfigurable length. Such an antenna can provide many different antenna configurations resulting in increased antenna flexibility.

Specifically, the invention provides an antenna having a reconfigurable length, comprising an enclosed composition capable of forming a plasma that is operable as an antenna; an energy source; and an enclosure containing the composition. The energy source can be configured for applying variable energy levels to the composition to thereby form variable plasma configurations. Further, the enclosure containing the composition can be configured having a proximal end, wherein upon application of a first energy level to the composition, a first plasma length with respect to the proximal end is formed, and upon application of a second energy level to the composition, a second plasma length with respect to the proximal end is formed.

In accordance with a more detailed aspect of the present invention, the enclosure can include an orientation axis extending away from the proximal end, a first cross-sectional area with respect to the orientation axis, and a second cross-sectional area with respect to the orientation axis.

In an alternative embodiment, a method of reconfiguring a plasma antenna can comprise the steps of energizing a composition within an enclosure to form a plasma that is operable as an antenna, wherein the plasma has a first length extending from a proximal end; and altering the level of energy applied to the composition such that the plasma is reconfigured to a second length extending from the proximal end or toward a distal end. In one embodiment, the enclosure can be further defined by an orientation axis extending away from the proximal end, a first cross-sectional area with respect to the orientation axis, and a second cross-sectional area with respect to the orientation axis.

Additional features and advantages of the invention will be apparent from the detailed description which follows, taken in conjunction with the accompanying drawings, which together illustrate, by way of example, features of the invention.

DETAILED DESCRIPTION OF THE PREFERRED EMBODIMENT(S)

Figure 1:
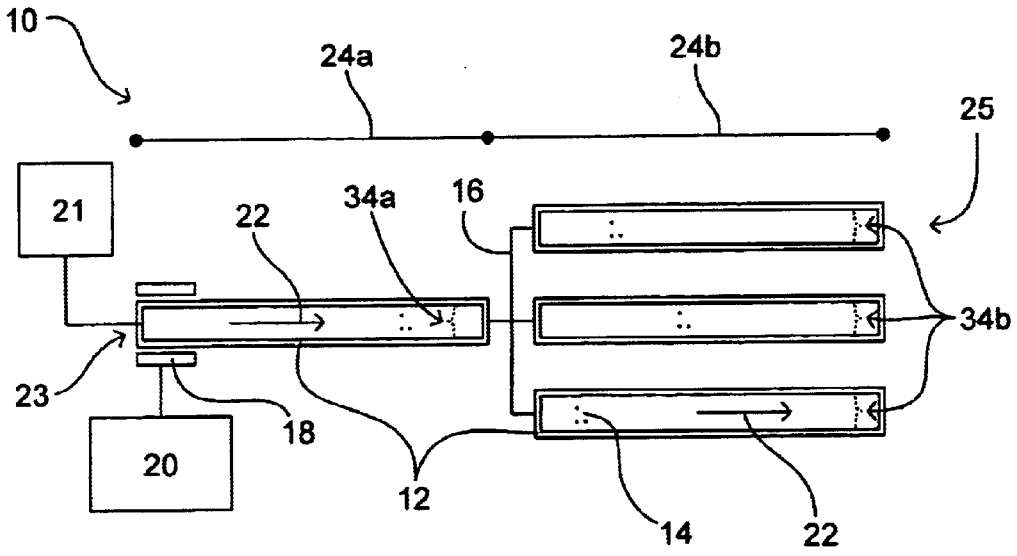
FIG. 1 is a schematic view of a plasma antenna system having stepped reconfigurable length in accordance with an embodiment of the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

As illustrated in FIG. 1, a plasma antenna system, indicated generally at 10, in accordance with the present invention is shown for an antenna having reconfigurable length. Specifically, an enclosure 12 which, in the present embodiment, comprises four dielectric tubes, encloses a composition 14 capable of forming a plasma. Exemplary compositions for use include gases that can be ionized to form a plasma, and can include argon, neon, helium, krypton, xenon, and hydrogen. Additionally, metal vapors capable of ionization such as mercury vapor can also be used. The enclosure 12 (represented by four dielectric tubes) is electrically interconnected by an electromagnetic coupler 16 such as a ballast.

A terminal 18 configured around the enclosure 12 is powered by an energy source 20. The energy source 20 introduces energy to the composition 14 within the enclosure via the terminal 18, which can convert the composition 14 to a plasma. Though the terminal 18 is not shown along the entire enclosure 12, it is understood that energy can be introduced to the composition 14 by a number of methods at any location where a plasma is desired to be formed. The energy source can provide energy to the composition through other types of terminals such as electrodes, fiber optics, high frequency signal, lasers, RF heating, electromagnetic couplers, and/or other mediums known by those skilled in the art. For example, with respect to embodiments where electrodes are used, the plasma can be created by a voltage differential between two electrodes. During ionization of the composition, the plasma formed can act as an effective antenna element. When the selected energy is terminated by cutting off the energy source 28, the antenna can cease to exist.

In accordance with one aspect of the present invention, the system 10 provides an orientation axis 22, showing a direction of length reconfigurability from a proximal end 23 to a distal end 25. Additionally, a first cross-sectional area 34*a* is defined by one of four tubes of the enclosure 12, and a second cross-sectional area 34*b* is defined by three of four tubes of the enclosure 12. Therefore, in this embodiment, assuming each of the four tubes has the same cross-section, the ratio of the first cross-sectional area 34*a* to the second cross-sectional area 34*b* is 1:3 by area. Other ratios are also possible by changing the number of tubes and/or the cross-sectional area of the tubes used. A signal generator or receiver 21 is also shown that is configured to contact the plasma, once formed from the composition 14, and to provide or receive signal to and from the plasma, respectively. In other words, the signal generator or receiver 21 can be used to couple electromagnetic signal (both receiving or transmitting) to the formed plasma. The signal generator or receiver may be configured to produce or receive radio frequency such as EHF, SHF, UHF, VHF, HF, and MF including AM or FM signals and digital spread spectrum signals, lower frequency signals such as LF, VLF, ULF, SLF, and ELF, and other known electromagnetic signals. Additionally, both continuous wave and pulsed signal can be transmitted or received using this antenna system.

With respect to an embodiment of the present invention, current density can be defined by current amps/cross-sectional area, or by electrons/second/cross-sectional area. In other words, for a given current, the cross-sectional area of a gas-filled enclosure plays a key role as to the density of the plasma formed. For example, at a fixed current, a gas confined within an enclosure of a first cross-sectional area may form a plasma of a density that can act as an antenna conductor. However, at the same current, the same gas at the same concentration within an enclosure of a larger cross-sectional area may not form a dense enough plasma to act as an antenna conductor. In order for a plasma to function as an antenna, a minimum plasma density must be present. Though the exact line of where a plasma can act as an antenna is difficult to define, the plasma density or frequency should preferably be at least about twice the frequency desired for signal transmission or reception.

With these principles in mind, plasma antenna system 10 at a first current can provide a plasma density within the enclosure 12 that is of the length of line segment 24*a*. This is because the current required to form a plasma that is dense enough to act as an antenna at the first cross-sectional area 34*a* is less than the current required to form a plasma that is dense enough to act as an antenna at the second cross-sectional area 34*b* (approximately three times more area at second cross-sectional area 34*b*). As plasma generating current passes along the orientation axis 22 and along the first cross-sectional area 34*a*, it gets divided substantially equally between three tubes that collectively define the second cross-sectional area 34*b*. Therefore, by increasing the current intensity by about three times greater than the minimum current required to form a plasma antenna of the length of line segment 24*a*, a plasma antenna of the collective length of line segments 24*a* and 24*b* can be formed.

Turning now to the remaining figures which illustrate alternative embodiments, the same compositions, energy sources, terminals, electromagnetic couplers, enclosure materials, types of electromagnetic signal, and the like, can be used, though specific discussion is not necessarily provided with respect to each embodiment.

Figure 2:
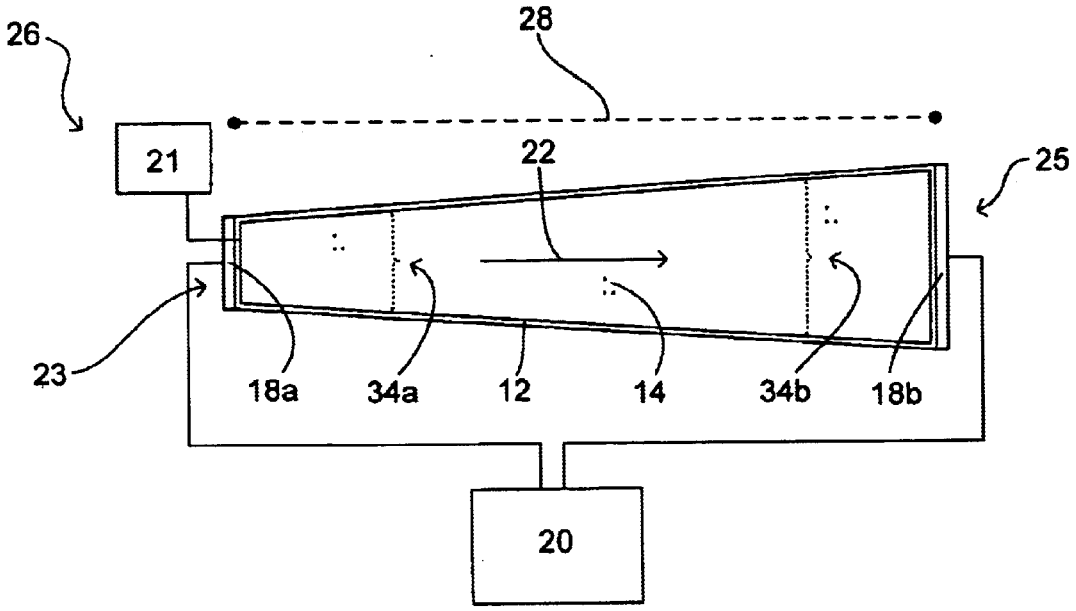
FIG. 2 is a schematic view of an alternative plasma antenna system having a continuously variable reconfigurable length in accordance with an embodiment of the present invention.

In FIG. 2, an alternative plasma antenna system 26 is shown, wherein the enclosure 12 is in a tapered configuration. Where FIG. 1 provides a stepped embodiment wherein a current change provides a "jump" in length, i.e., from the length of line segment 24*a* to the collective length of line segments 24*a* and 24*b*, or vice versa, FIG. 2 provides an embodiment where the length can be continuously and variably changed by changing the current level. Dotted line segment 28 illustrates that the length of the plasma antenna is only fixed by the structural ends of the enclosure 12, and that any plasma antenna length from the proximal end 23 to the distal end 25 is theoretically formable. FIG. 2 provides a composition 14 capable of forming a plasma within the enclosure 12, and an energy source 20 which energizes the composition 14 via terminal 18*a*, 18*b*, which in this embodiment is a pair of electrodes. A signal generator or receiver 21 is electromagnetically coupled to the plasma, once formed from the composition 14. A first cross-sectional area 34*a* with respect to an orientation axis 22 is more toward a proximal end 23 and a second cross-sectional area 34*b* with respect to the orientation axis 22 is more toward a distal end 25. These cross-sectional areas 34*a*, 34*b* have been arbitrarily placed, as either can be anywhere along the orientation axis 22, from the proximal end 23 to the distal end 25. As the enclosed configuration is tapered, there are theoretically an infinite number of cross-sectional areas along the orientation axis 22.

As a current is initiated and increased from the energy source 20 through the terminal 18*a*, 18*b*, a plasma dense enough to act as an antenna can be increased in length from the proximal end 23 to the terminal end 25. Likewise, by decreasing the current level, the antenna can be decreased in length. Thus, by merely altering the current, the effective length of the plasma antenna can be altered, i.e., increasing or decreasing the length. In one embodiment, when the effective plasma (plasma density capable of operating as an antenna) length is within a tapered enclosure, and the current received is of a constant magnitude, the current density will be variable along the effective plasma antenna length. In other words, the current density will generally be greater at the proximal (tapered) end 23, and lower toward the distal end 25.

In a further detailed aspect, the antennas of the present invention can be configured for frequency hopping applications. For example, the antenna can be configured to increase in length so that a different frequency can be propagated more effectively. In one embodiment, a ¼ wavelength change can be propagated along the length of the antenna by changing the current level in an increment to effectuate an effective plasma density change to a desired length. Other increments of length change can also be carried out, as would be known by one skilled in the art.

Figure 3:
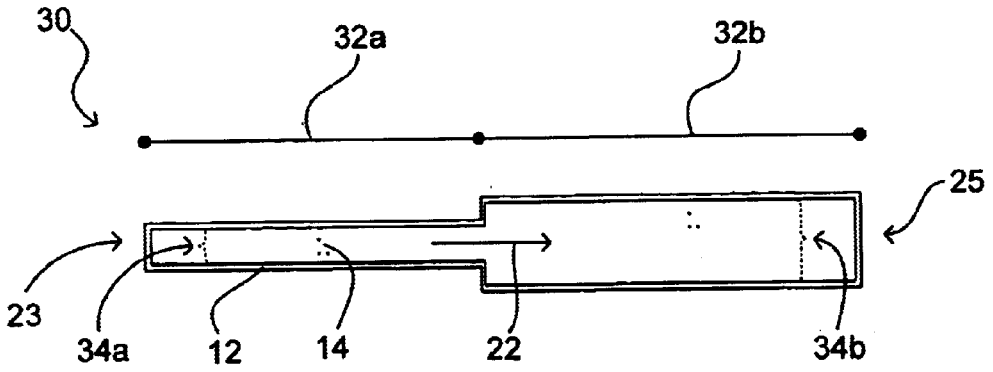
FIG. 3 is a schematic view of a plasma antenna system having stepped reconfigurable length in accordance with an embodiment of the present invention.

Referring now to FIG. 3, an alternative embodiment of an antenna system 30, wherein an enclosure 12 having a proximal end 23 and a distal end 25 is shown. The enclosure 12 contains a composition 14 capable of forming a plasma operable as an antenna. Further, the enclosure 12 has two specific cross-sectional areas, similar to that shown in FIG. 1. Specifically, a first cross-sectional area 34*a* with respect to an orientation axis 22 is less than a second cross-sectional area 34*b*. However, unlike FIG. 1, the first and second cross-sectional areas 34*a*, 34*b* are in fluid communication with one another, rather than in mere electrical communication through a ballast. As in the FIG. 1 example, second cross-sectional area 34*b* can be three times greater than first cross-sectional area 34*a*, or any other functional ratio as needs may arise.

As two effective antenna lengths are possible with this embodiment, i.e., the length of line segment 32*a* and the collective length of line segments 32*a* and 32*b*, one skilled in the art would recognize after reading the present disclosure that more than two cross-sectional areas can be present. Further, each cross-sectional area does not have to provide the same length. One can be a first length and another can be a second length, depending on the desired application. However, unlike the tapered embodiment shown in FIG. 2, when a section of the enclosure 12 provides a common cross-sectional area, once the density of the plasma within that section reaches a point that would support antenna function, the entire section will be substantially activated as an antenna. In this matter, the antenna length can said to be reconfigurable by a step, rather than by variable length changing, as can occur with the tapered enclosure embodiment of FIG. 2. For example, in considering the embodiment shown in FIG. 3, when the plasma becomes dense enough to support antenna function in section 32*b*, the effective length plasma antenna will jump or step from the length of line segment 32*a* to the length of both line segments 32*a* and 32*b*.

Figure 4:
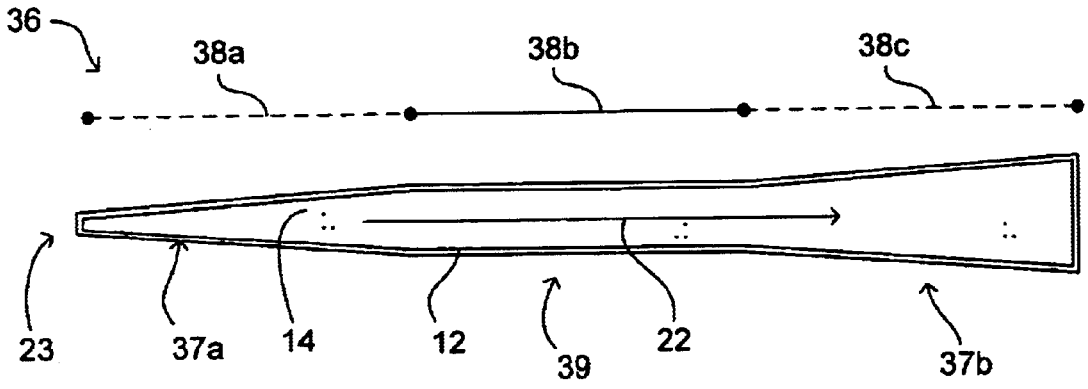
FIG. 4 is a schematic view of a plasma antenna system having both a stepped and a continuously variable reconfigurable length component in accordance with an embodiment of the present invention.

In FIG. 4, a plasma antenna system 36 is shown having an enclosure 12 that combines tapered sections 37*a*, 37*b* and a non-tapered section 39. Though system 36 provides a specific stepped and tapered arrangement, other arrangements of this embodiment are possible as would be apparent to one skilled in the art after considering the present disclosure. The enclosure 12 contains a composition 14 capable of forming a plasma. Along the tapered sections 37*a*, 37*b* of the enclosure 12, there are an infinite number of cross-sectional areas with respect to an orientation axis 22. Dotted line segments 38*a*, 38*c* indicate that the length can be variably reconfigured by variably increasing or decreasing current. However, along the non-tapered section 39, there is only one cross-sectional area, as indicated by solid line segment 38*b*. As current is introduced by an energy source (not shown) to the proximal end 23 of the enclosure 12, the composition 14 becomes a plasma. As the density of the plasma increases with increased current, a plasma antenna is formed near the proximal end 23 and is variably lengthened, as indicated by dotted line segment 38*a*. Once the plasma antenna is lengthened to a point where it reaches non-tapered section 39 of the enclosure 12, the effective plasma antenna will jump to the collective length of line segments 38*a* and 38*b*. Current can then be further increased to variably increase the length of the effective plasma antenna along tapered section 37*b*.

Figure 5:
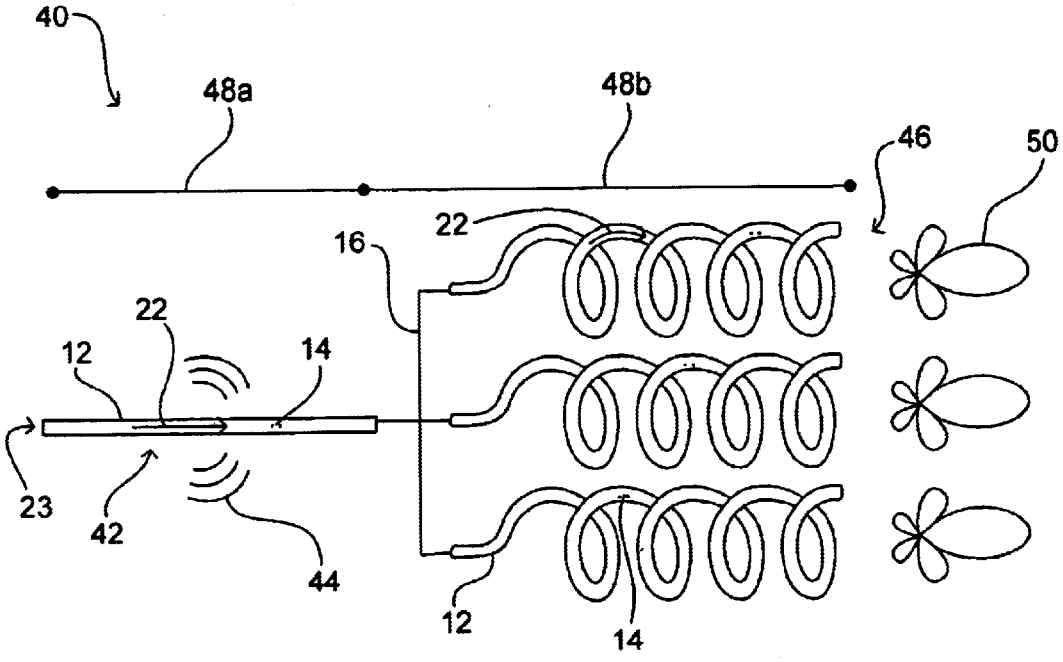
FIG. 5 is a schematic view of a plasma antenna system having stepped reconfigurable length and reconfigurable beamwidth in accordance with an embodiment of the present invention.

Turning now to FIG. 5, a plasma antenna system 40 is shown having two different types of enclosure structures. Specifically, a linear plasma antenna 42 for generating a more omni-directional signal 44 is coupled in series to three parallel helical plasma antennas 46 for generating a more directional signal 50. The linear plasma antenna 42 provides a first cross-sectional area with respect to an orientation axis 22, and the helical plasma antennas collectively provide a second cross-sectional area with respect to the orientation axis 22. FIG. 5 is similar to FIG. 1 except that helical antennas 46 are used instead of linear antennas after the electromagnetic coupler 16 splits the current into three fractions. As described previously, the enclosure 12 (which includes both the linear and helical chambers) contains a composition 14 capable of forming a plasma operable as an antenna. By using helical plasma antennas 46, not only can the length be reconfigured, i.e. from the length of line segment 48*a* to the collective length of line segments 48*a* and 48*b*, but beamwidth can be reconfigured. For example, upon introduction of a first current at the proximal end 23, an omni-directional signal 44 can be provided by the linear plasma antenna 44. Then, by increasing the current to a level where the density of the plasma within the helical plasma antennas 46 is sufficiently dense, a more directional signal 50 can be added to the omni-directional signal being produce by the linear plasma antenna 42.

Figure 6:
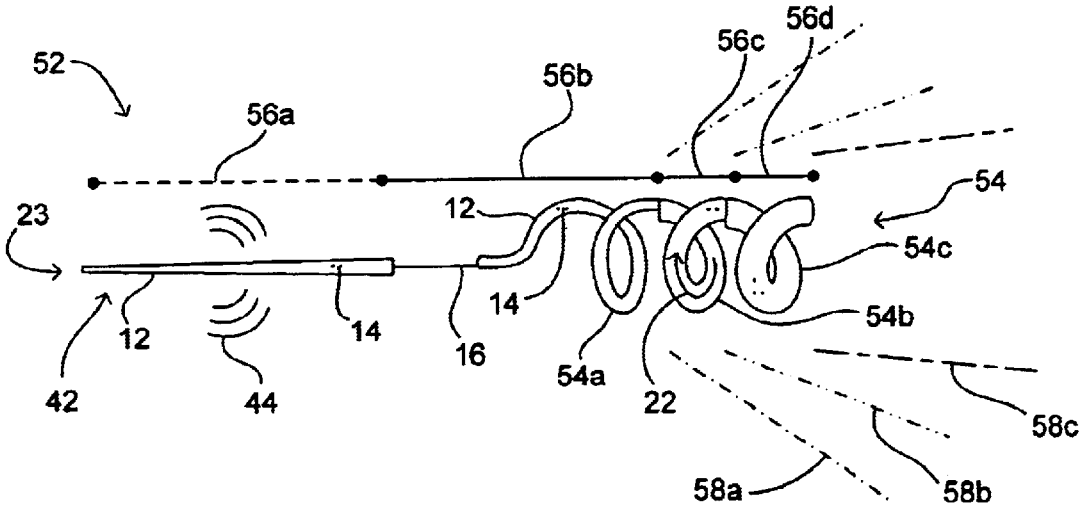
FIG. 6 is a schematic view of a plasma antenna system having variable and stepped reconfigurable length, as well as reconfigurable beamwidth in accordance with an embodiment of the present invention.

In FIG. 6, a plasma antenna system 52 is provided which electrically connects a tapered linear antenna 42 with a stepped helical antenna 54 via an electromagnetic coupler 16, though they can alternatively be fluidly connected. Tapered linear antenna 42 can be configured similarly to the structure of FIG. 2, including a tapered-portion of the enclosure 12 and a composition 14 capable of forming a plasma operable as an antenna. Linear antennas generally are known to produce omnidirectional signal, and thus, an omnidirectional signal 44 is shown as emitted from tapered linear antenna 42. The signal 44 emitted can be affected by the antenna length which is dependent, at least in part, on the current introduced. Dotted line segment 56*a* schematically represents the variable length that can result from variable current introduced to the tapered linear antenna 42.

A stepped helical antenna 54 is also provided that is connected in series to the tapered linear antenna. If enough current reaches the stepped helical antenna, a more directional signal can be transmitted. Generally, with respect to helical antennas, by altering the number of turns, beamwidth can reconfigured. For example, a lower number of turns result in a wider beamwidth, whereas a larger number of turns result in a narrower beamwidth. In the embodiment shown, from 0 to 3 turns is possible, though this number can be modified to as many turns as desirable and/or practical for a given application. The number of turns will depend on the current introduced to the stepped helical antenna 54.

One skilled in the art would recognize that the linear antenna portion is not necessary to utilize the helical portion of the antenna system shown. They are shown in combination to depict an embodiment of the invention whereby multiple antennas of different configurations can be combined. In other words, the tapered linear antenna 42 and the stepped helical antenna 54 are shown together as part of a system, but could easily be split into two separate antenna systems as would be apparent to one skilled in the art after reading the present disclosure. For example, a signal generator (not shown) can be connected directly to the helical antenna portion of the system, rather than at a proximal end 23 of the enclosure 12.

In further detail with respect to the stepped helical antenna 54, the first turn 54*a* has a cross-sectional area with respect to its orientation axis 22 that is less than the cross-sectional area of the second turn 54*b*. Further, the second turn 54*b* has a cross-sectional area that is less than the cross-sectional area of the third turn 54*c*. Each of the turns 54*a*, 54*b*, and 54*c* are fluidly connected by the composition 14 within the helical portion of the enclosure 12. When the first turn 54*a* is activated as an antenna, the antenna length can be the sum length of dotted line segment 56*a* and solid line segment 56*b*, and the beamwidth provided by turn 54*a* can be broad as shown by signal 58*a*. By increasing the current, the second turn 54*b* can be activated to form a plasma that is effective as an antenna, increasing the length by the length of solid line segment 54*c*, and narrowing the bandwidth to that shown by signal 58*b*. Likewise, by increasing the current further, the third turn 54*c* can be activated to form a plasma that is effective as an antenna, increasing the length by the length of solid line segment 54*d*, and narrowing the bandwidth to that shown by signal 58*c*.

Stepped helical antenna 54 illustrates the principle that current can be increased to stepwise increase the length of a helical antenna. The beamwidths shown are not the actual beamwidths that would necessarily be emitted from a single, double, or triple turn helical antenna. The signals 58*a*, 58*b*, and 58*c* are merely schematically depicted this way to show that beamwidth can be narrowed by increasing the number of turns. For example, a single turn will actually emit a more omnidirectional signal, and it may take three or four turns before desired directivity can start to be achieved. Therefore, the present three-turn embodiment has been depicted for simplicity, as the three turns shown could also be at the terminal end of a helical antenna having two or more preliminary turns.

Figure 7:
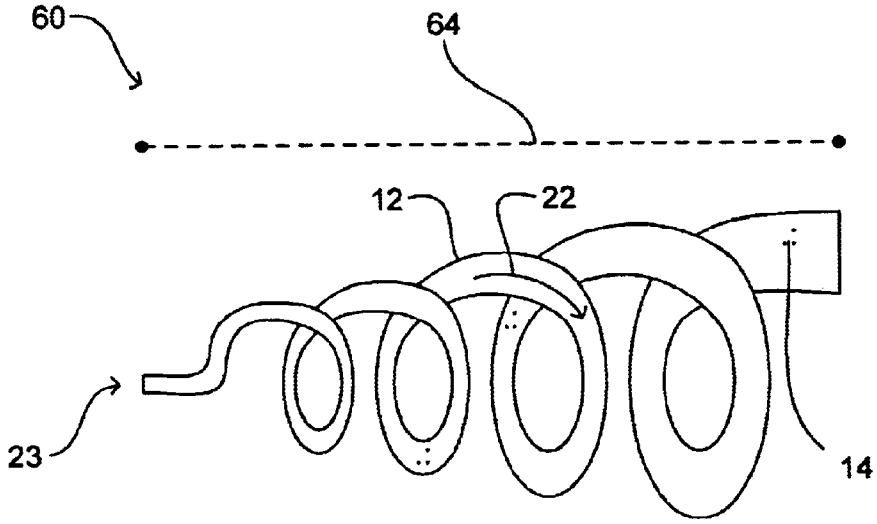
FIG. 7 is a schematic view of a plasma antenna system having variable reconfigurable length as well as reconfigurable beamwidth in accordance with an embodiment of the present invention.
Figure 8:
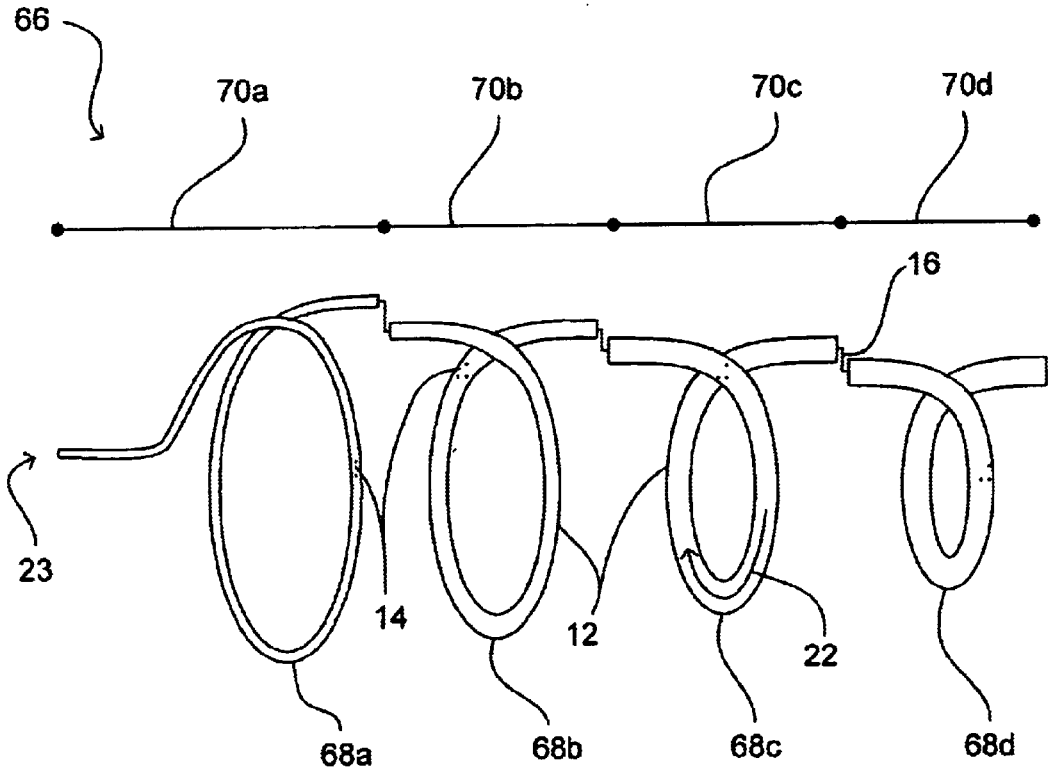
FIG. 8 is a schematic view of a plasma antenna system having stepped reconfigurable length as well as reconfigurable beamwidth and bandwidth in accordance with an embodiment of the present invention.

FIGS. 7 and 8 depict a tapered spiral antenna 60 and a stepped conical spiral antenna 66, respectively. A spiral antenna and a conical spiral antenna typically provide turns, similar to a helical antenna, except that the turns are not of a common diameter. With a spiral antenna, as more turns are added, the diameter of the turns increases. Further, with a spiral antenna, as the number of turns are increased, upon electromagnetic wave transmission, the bandwidth is increased and beamwidth is substantially unaffected. Therefore, by utilizing principles of the present invention, a spiral antenna can be formed that is reconfigurable as to beamwidth (as well as length). With a conical spiral antenna, as more turns are added, the diameter of the turns decreases. Further, with a conical spiral antenna, as the number of turns is increased, the beamwidth is decreased and the bandwidth is increased. Therefore, by utilizing principles of the present invention, a conical spiral antenna can be formed that is reconfigurable as to beamwidth and bandwidth (as well as length).

With specific reference to FIG. 7, a tapered spiral antenna 60 is shown that is defined by a spiral and tapered enclosure 12, and contains a composition 14 capable of forming a plasma. The orientation axis 22 follows the centerline of the spiral antenna 60. As the enclosure is tapered, and as current is increased from the proximal end 23 along the orientation axis 22, the number of turns can be increased. In this embodiment, the number of turns need not be increased stepwise, but can be increased variably, as schematically represented by dotted line segment 64.

FIG. 8 depicts a stepped conical spiral antenna 66 that comprises an enclosure 12, having a proximal end 23, and containing a composition 14 capable of forming a plasma operable as an antenna. The conical spiral configuration shown includes four sectioned turns. A first turn 68*a* provides a cross-sectional area with respect to an orientation axis 22 that is less than the cross-sectional area of a second turn 68*b* (which is less than third turn 68*c* which is less than fourth turn 68*d*). Each of the turns are electromagnetically coupled together by electromagnetic couplers 16 to provide current flow, in series, from first turn 68*a* through fourth turn 68*d*. By increasing current through the composition 14 (or plasma), the length (from the length of line segment 70*a* through the sum length of line segments 70*a*, 70*b*, 70*c*, and 70*d*), beamwidth, and bandwidth can be reconfigured as previously described.

Figure 9:
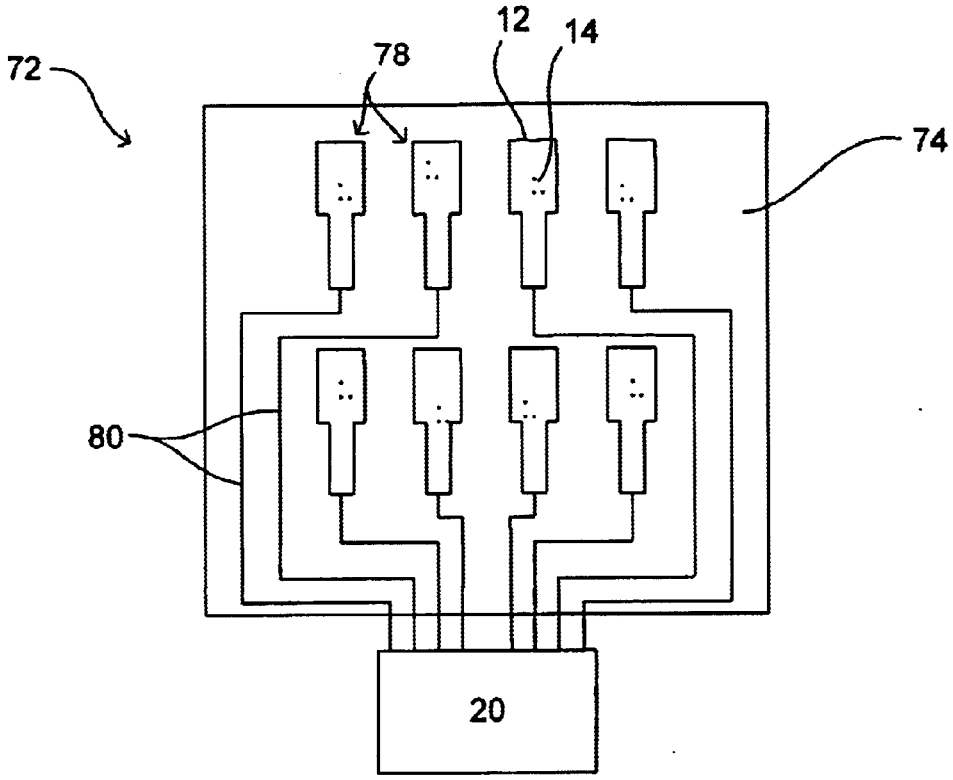
FIG. 9 is a schematic view of a plasma antenna system array having individual stepped reconfigurable length antenna elements.

FIG. 9 depicts an antenna array system 72 having individual antennas 78 arranged in a planer array configuration. Each antenna comprises an enclosure 12 containing a composition 14 capable of forming a plasma. The array of antennas is positioned on an optional dielectric substrate 74 to support the individual antennas 78 in a fixed configuration. Each individual antenna 78 in this embodiment is configured similarly to the antenna element shown in FIG. 3, though any antenna configuration having reconfigurable length can be used. Each antenna 78 is also individually electrically coupled to an energy source 20 that is configured to generate plasma within the individual enclosures 12 of the individual antenna elements 78. The electromagnetic coupling of the antenna elements 78 to the energy source 20 is effectuated by wire couplers 80, which can be metal wires. Other methods of coupling electromagnetic energy source 20 to the antenna elements 78 can be used. If metal wires 78 are used, then the radius of the metal wires can be small compared to the wavelength of the signal the antenna elements 78 are configured to absorb or reflect. If the wires 80 used are small enough in this respect, they will not substantially interfere with the antenna elements 78 and their function. However, if there is interference, such as by the use of larger wires, because the antenna elements 78 are reconfigurable, they can be adjusted in length and/or conductivity to compensate for any interference caused by the wire couplers 80.

The design shown in FIG. 9 is exemplary, as other antenna element types or number of antenna elements can be varied. Additionally, the array can be further coupled to a signal source and/or a receiver for transmitting and/or receiving signal, respectively. In the embodiment shown, no such receiver or transmitter is present, and thus, the system as shown can be used as a reconfigurable passive filter, or as a frequency selective surface. Further, the array can also be used as part of a stacked system, where multiple planer arrays 72 are stacked for a desired purpose.

The dynamic reconfigurability, which includes reconfigurability of length or size of the elements, and which antenna elements are energized, can provide for various desired results, as would be apparent to one skilled in the art after considering the present disclosure. For example, the size of the antenna elements can affect the frequency selectivity of the surface of the system 72. For example, plasma can be generated within one or more of the antennas that cause certain electromagnetic frequencies to be reflected, while other frequencies are allowed to pass therethrough. As more of each of the elements has a plasma that is energized to act as antenna, there is less space between each plasma element. In one embodiment, the more antennas that are energized at a longer configuration, the more energy that gets reflected or absorbed. By turning off certain elements (by reducing the plasma density), or by reducing the length of one or more antenna elements as described herein, larger space is provided between elements and less reflectance and/or absorption occurs. In other words, when all of the antenna elements are energized at full length, maximum filtration can occur at a pre-selected frequency that the system is designed for use with. When all of the antenna elements lack plasma that can act as an antenna element (not energized at all, or not energized sufficiently to reflect or absorb signal), no filtration occurs. Further, intermediate filtration can occur by 1) energizing one element from a shorter length to full length, 2) energizing some of the elements from their respective shorter lengths to their full lengths, or 3) energizing or all of the elements wherein one or more element is less then its full length.

Figure 10:
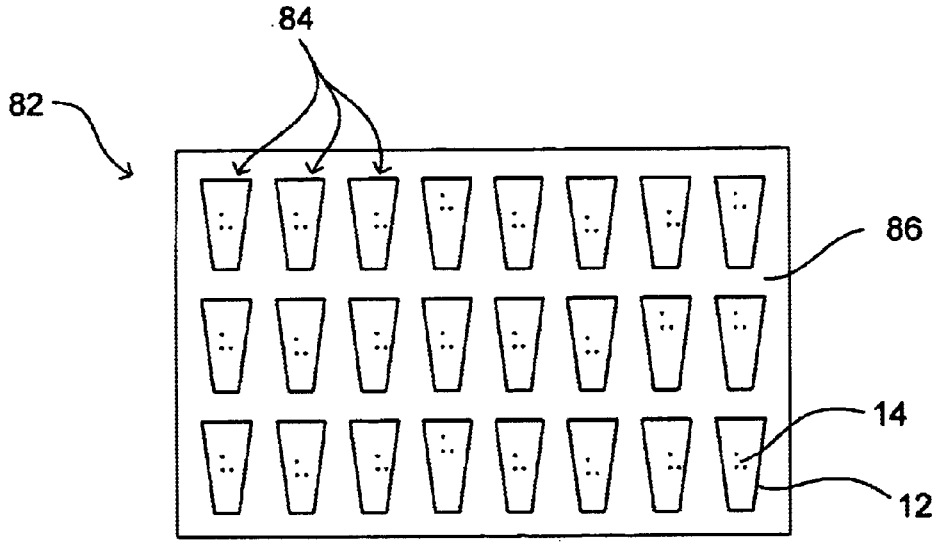
FIG. 10 is a schematic view of a plasma antenna system array having individual variable reconfigurable length antenna elements.

Turning to FIG. 10, a system 82 similar to FIG. 9 is shown that has a different number of antenna elements 84 for use with the array. Again, each antenna comprises an enclosure 12 containing a composition 14 capable of forming a plasma. However, the antenna elements 84 used are of the tapered configuration, such as are shown in FIG. 2. Again, a dielectric substrate 86 is shown that supports the antenna elements 84. Rather than the ability to reconfigure the length of each antenna element from an off configuration to two specific lengths, a variable continuum of lengths can be generated, as described with respect to FIG. 2. If each antenna element 84 of the array 82 is individually attached to an energy source (not shown), then each can be reconfigured from being turned off to a full-length antenna, and to any functional length in between.

Though only a few examples of the use of tapering or stepped cross-sectional change are provided, it is to be understood that other antenna structures can be modified in accordance with principles of the present invention. For example, both active and passive plasma antennas or filters can be formed including log-periodic antennas, yagi antennas, reflector antennas, aperture antennas, wire antennas of all varieties, dipole antennas, loop antennas, waveguides, lens antennas, bent antennas, discontinuous antennas, terminated antennas, truncated antennas, horn antennas, spiral antennas, conical spiral antennas, helical antennas, array antennas, traveling wave antennas, microstrip antennas, and the like, can benefit from the reconfigurability provided by strategic tapering or stepped cross-sectional change properties.

It is to be understood that the above-referenced arrangements are illustrative of the application for the principles of the present invention. Numerous modifications and alternative arrangements can be devised without departing from the spirit and scope of the present invention while the present invention has been shown in the drawings and described above in connection with the exemplary embodiments(s) of the invention. It will be apparent to those of ordinary skill in the art that numerous modifications can be made without departing from the principles and concepts of the invention as set forth in the claims.

What is claimed is:

1. An antenna having a reconfigurable length, comprising:

an enclosed composition capable of forming a plasma;

an energy source configured for applying variable energy levels to the composition to thereby form a plasma operable as an antenna; and an enclosure containing the composition, said enclosure having a proximal end, wherein upon application of a first energy level to the composition, a first plasma length with respect to the proximal end is formed, and upon application of a second energy level to the composition, a second plasma length with respect to the proximal end is formned.

2. An antenna as in claim 1, further defined by an orientation axis extending away from the proximal end, a first cross-sectional area with respect to the orientation axis, and a second cross-sectional area with respect to the orientation axis.

3. An antenna as in claim 2, wherein upon the composition receiving a first amount of energy, the plasma is present at the first cross-sectional area and not at the second cross-sectional area, and wherein upon the composition receiving a second amount of energy, the plasma is present at the first cross-sectional area and the second cross-sectional area.

4. An antenna as in claim 2, wherein the first plasma length is from the proximal end to the first cross-sectional area, and the second plasma length is from the proximal end to the second cross-sectional area.

5. An antenna as in claim 1, wherein the length of the antenna is increased as the first energy level is increased to the second energy level.

6. An antenna as in claim 1, wherein the enclosure is a tapered enclosed chamber.

7. An antenna as in claim 1, wherein the enclosure is a stepped enclosed chamber.

8. An antenna as in claim 2, wherein the enclosure is a plurality of enclosed tubes electromagnetically coupled together.

9. An antenna as in claim 8, wherein the plurality of enclosed tubes comprises a first tube and a second tube connected in series, the first tube defining the first cross-sectional area and the second tube defining the second cross-sectional area.

10. An antenna as in claim 8, wherein the plurality of enclosed tubes is a first tube connected in series to at least two additional tubes, said at least two additional tubes being connected to each other in parallel, said first tube defining the first cross-sectional area, said at least two additional tubes defining the second cross-sectional area.

11. An antenna as in claim 2, wherein at least a portion of the enclosure is configured in a helical arrangement, providing beamwidth reconfigurability.

12. An antenna as in claim 1, wherein at least a portion of the enclosure is configured in a spiral arrangement, providing bandwidth reconfigurability.

13. An antenna as in claim 1, wherein at least a portion of the enclosure is configured in a conical spiral arrangement, providing beamwidth and bandwidth reconfigurability.

14. An antenna as in claim 1, wherein the enclosure comprises at least two enclosed chambers connected in series, each enclosed chamber having a different configuration.

15. An antenna as in claim 1, wherein the enclosure comprises a tapered portion and a non-tapered portion.

16. An antenna as in claim 1, wherein the enclosure comprises a first tube that is linear and a second tube that is non-linear.

17. An antenna as in claim 1, wherein the plasma formed upon application of a first energy level is less than the length of the enclosure.

18. An antenna as in claim 1, wherein the composition is a gas selected from the group consisting of neon, xenon, argon, krypton, hydrogen, helium, mercury vapor, and combinations thereof.

19. An antenna as in claim 1, further comprising a signal generator or receiver electromagnetically coupled to the plasma for transmitting or receiving signal, respectively.

20. An antenna as in claim 1, wherein at least two plasma configurations are formable within the enclosure.

21. An antenna as in claim 1, wherein the antenna is part of a planer array of other plasma antennas.

22. An antenna as in claim 1, wherein the antenna is part of a stacked array of other plasma antennas.

23. A method of reconfiguring a plasma antenna, comprising:

energizing a composition within an enclosure to form a plasma that is operable as an antenna, said plasma having a first length extending from a proximal end;

altering the level of energy applied to the composition such that the plasma is reconfigured to a second length extending from the proximal end.

24. A method as in claim 23, wherein the enclosure is further defined by an orientation axis extending away from the proximal end, a first cross-sectional area with respect to the orientation axis, and a second cross-sectional area with respect to the orientation axis.

25. A method as in claim 24, wherein the first length is provided by a first amount of energy applied to the composition such that the plasma is formed at the first cross-sectional area.

26. A method as in claim 25, wherein the second length is provided by a second amount of energy applied to the composition such that the plasma is formed at the second cross-sectional area.

27. A method as in claim 24, wherein the energizing step provides a plasma at both the first cross-sectional area and the second cross-sectional area, and the altering step provides a plasma at the first cross-sectional area and not at the second cross-sectional area.

28. A method as in claim 24, wherein the energizing step provides a plasma at the first cross-sectional area and not at the second cross-sectional area, and the altering step provides a plasma at both the first cross-sectional area and the second cross-sectional area.

29. A method as in claim 23, further comprising the step of energizing a second composition within a second enclosure such that the composition becomes a second plasma operable as an antenna, said second enclosure being positioned next to the enclosure as part of a planer array.

30. A method as in claim 29, further comprising the step of altering the level of energy applied to the second composition such that the second plasma is reconfigured in length.

* * * * *